United States Patent [19]

Chelminski

[11] 4,266,844

[45] May 12, 1981

[54] HIGH STRENGTH SUBMERSIBLE ELECTRICAL CABLE AND CONNECTOR ASSEMBLY

[75] Inventor: Paul Chelminski, Norwalk, Conn.

[73] Assignee: Bolt Associates, Inc., Norwalk, Conn.

[21] Appl. No.: 67,768

[22] Filed: Aug. 20, 1979

[51] Int. Cl.[3] ..... H01R 3/00; H01R 13/58

[52] U.S. Cl. ..... 339/218 M; 339/116 C; 339/103 R

[58] Field of Search ..... 339/218 R, 218 M, 115 R, 339/115 C, 116 R, 116 C, 147 R, 147 P, 94 R, 94 M, 103 R, 103 M; 174/74 R, 76, 84 C

[56] References Cited

U.S. PATENT DOCUMENTS

| | | | |
|---|---|---|---|
| 3,193,792 | 7/1965 | Shea | 174/84 C X |
| 3,588,039 | 6/1971 | Chelminski | 251/141 |
| 3,816,641 | 6/1974 | Iversen | 339/218 R X |
| 3,963,297 | 6/1976 | Panek et al. | 339/94 M |
| 4,025,717 | 5/1977 | Wittingham | 174/76 X |

FOREIGN PATENT DOCUMENTS

| | | | |
|---|---|---|---|
| 1020395 | 12/1957 | Fed. Rep. of Germany | 339/218R |

*Primary Examiner*—Eugene F. Desmond

*Attorney, Agent, or Firm*—Parmelee, Johnson, Bollinger & Bramblett

[57] ABSTRACT

A high strength submersible electrical cable and connector assembly are described which are particularly suitable for use with high pressure valve actuated devices such as air guns which operate in harsh environments such as at sea and which generate large vibrational forces and where the cable and connector are subject to towing stresses as the air gun is towed through the water during a seismic survey operation. The connector has a sleeve body member with a socket retainer in one end adapted to be coupled to a solenoid valve on the air gun. A non-conductive anchor plug is mounted within the sleeve body and mechanically and electrically secures in the sleeve an electrical cable having a plurality of insulated high tensile strength electrical conductors. A plurality of electrical conductors are coupled between the retainer socket and the high tensile strength electrical conductors which are held by electrical connectors seated within the non-conductive anchor plug, and the sleeve body is filled with insulating material to encapsulate the anchor plug and the various connectors and electrical connections within the sleeve body. A tough, protective tapered insulating jacket surrounds the electrical cable and sleeve body in the region where the electrical cable containing the plurality of insulated high tensile strength electrical conductors enters the sleeve body to provide additional strain-relief for the connector assembly. The electrical cable and connector assembly is characterized by being rugged and water tight so as to be able to withstand the large vibrations generated by air guns in such applications as seismic surveying and is further capable of being submersible in water where seismic surveying is performed, and the assembly enables a smaller diameter electrical cable to be used than heretofore while providing a longer operating life under marine seismic surveying conditions.

5 Claims, 5 Drawing Figures

HIGH STRENGTH SUBMERSIBLE ELECTRICAL CABLE AND CONNECTOR ASSEMBLY

BACKGROUND OF THE INVENTION

This invention relates to a rugged, high strength, submersible electrical cable and connector assembly particularly suitable for use with solenoid-operated valves for actuating air guns in marine seismic surveying.

In accordance with such applications, the invention relates to an electrical cable and connector assembly which is submersible in salt water and in other aspects relates to such an assembly which is capable of withstanding large vibrational forces associated with the firing of air guns as well as other forces such as the stresses of towing long lengths of cable through a body of water.

Seismic energy sources, commonly referred to as air guns, are utilized in marine seismic surveying to generate powerful seismic impulses by releasing high pressure air and other gases in an abrupt and repeatable manner at short spaced intervals at selective depths within a body of water, within a bore in the earth, or within a confined volume of water above a diaphragm pressing the earth surface. The magnitude of the seismic energy impulses generated are large as the guns usually employ air pressures of several thousand pounds per square inch. Solenoid-operated valves for triggering the release of the high pressure air from the air guns are remotely controlled from a ship or other surface installation. Accordingly, an electrical cable and connector assembly must be able to function reliably in the face of the large vibrational forces generated by firing of the air gun as well as being able to withstand the towing stresses in the water through which the cable extends as the air gun is being towed during a seismic survey operation at sea.

U.S. Pat. No. 3,588,039 entitled "Solenoid Valve Structures and Systems", which is assigned to the assignee of the present invention, illustrates a high tensile strength electrical cable and connector system which has been successfully employed in seismic surveying applications. The electrical cable contains a central flexible stranded stainless steel cable which is mechanically fastened in the connector assembly to a steel anchor plug positioned in a sleeve body member of the connector system. Insulated electrical conductors are helically wound around the stranded steel cable and extend through passages in the metallic anchor plug and are connected to electrical sockets positioned in an end piece of the connector assembly. Although such an arrangement has proven suitable, it has several disadvantages.

First of all, it requires a strengthening steel cable running axially through the electrical cable which performs only a mechanical function of withstanding towing stresses. The electrical conductors which perform the control function are helically wound around the steel cable core, and accordingly they are positioned close to the perimeter of the cable. In other words, the insulated electrical wires are positioned relatively far from the axis of the over-all cable and accordingly they are placed under greater stress than would be the case were they located more centrally in the cable in the space taken up by the steel cable core.

Secondly, the insulated electrical conductors must extend through openings in the steel anchor plug and may become short circuited if the insulation thereon is damaged by the plug due to the large vibrational forces which are applied to the assembly by the repeated firings of the air gun.

Third, the prior art cable is relatively bulky because the steel cable core increases its over-all diameter, and then the electrical conductors must be well insulated from this steel core as well as being well insulated from the surrounding sea water or other environment, which further increases the bulk of the composite cable. The present invention is directed to a new and improved structure which alleviates these as well as other problems with respect to the electrical cable and connector assembly.

SUMMARY OF THE INVENTION

Accordingly, it is an object of this invention to provide a new and improved electrical cable and connector assembly adapted to be connected to the solenoid-operated control valves of high pressure fluid-actuated apparatus, such as air guns, and which is rugged, is submersible and has relatively high strength for withstanding towing stresses and vibrations in being towed through a body of water.

A further object of this invention is to provide a new and improved electrical cable and connector assembly which is capable of withstanding large vibrational and other forces as well as being adaptable for uses in various harsh environments where severe weathering agents are present such as salt water, wind or waves.

A further object of this invention is to provide a new and improved electrical cable and connector assembly which may be readily fabricated and assembled and is more compact and utilizes less material than such assemblies which have been utilized in the past for similar applications.

In carrying out this invention in one illustrative embodiment thereof, a high strength submersible electrical cable and connector assembly is provided having an electrical cable with a plurality of insulated high tensile strength electrical conductors extending centrally therein generally along the axis thereof and being sheathed in insulation. The electrical cable is coupled to a connector having a sleeve body member with a retainer socket in one end thereof which is adapted to be connected to high pressure solenoid valve actuated apparatus. A non-conductive anchor plug is mounted in the sleeve body having a plurality of electrical connector means therein for mechanically and electrically securing the plurality of high tensile strength electrical conductors in the anchor plug in the sleeve body. A plurality of electrical conductors are coupled between the electrical connector means in the non-conductive anchor plug and the retainer socket, and the entire sleeve body is potted with insulating material. A tough, insulating, tapered jacket surrounds the electrical cable and sleeve body member for providing additional strain-relief and flexural transition for the assembly.

Advantageously, in accordance with the present invention, a central flexible stranded steel cable along with a steel anchor plug are eliminated and a more compact cable is provided, while the over-all assembly provides a longer operating life under marine seismic surveying conditions.

BRIEF DESCRIPTION OF THE DRAWINGS

The invention, together with further objects, aspects, features and advantages thereof, will become more fully understood from a consideration of the following detailed description taken in conjunction with the accompanying drawings.

DESCRIPTION OF THE PREFERRED EMBODIMENTS

Figure 1:
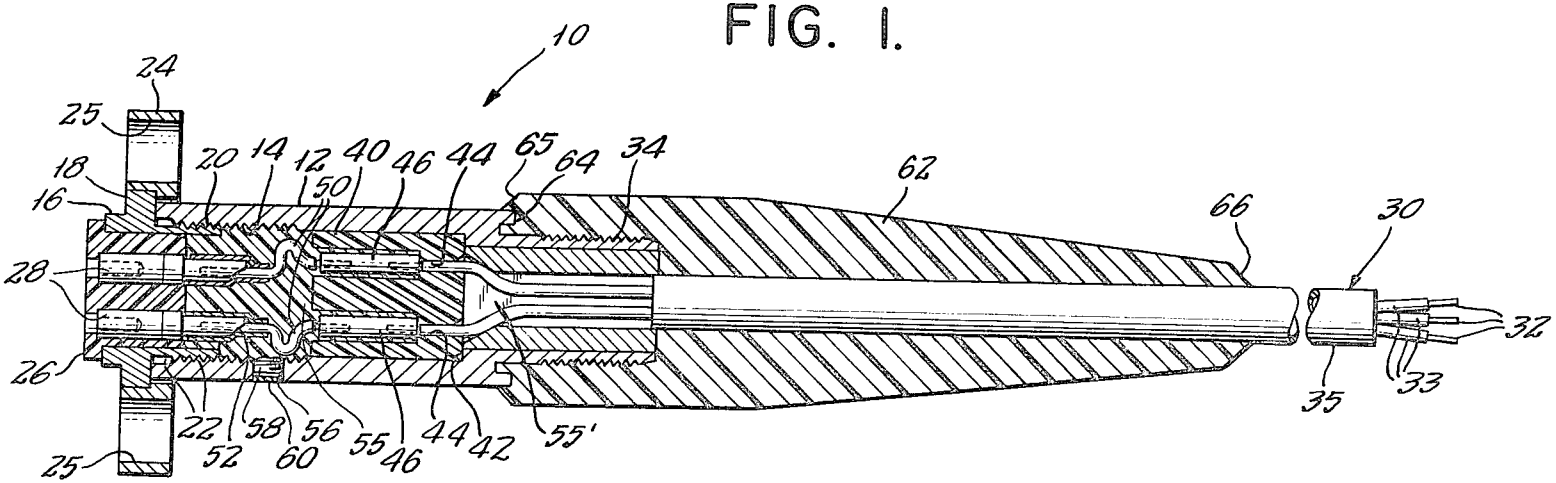
FIG. 1 is a longitudinal sectional view of the new and improved high tensile strength submersible electrical cable and connector assembly in accordance with the present invention.

Referring now to FIG. 1, the high strength submersible electrical cable and connector assembly includes a connector assembly referred to generally with the reference numeral 10 attached to an electrical cable 30. The connector assembly 10 includes a stainless steel body member 12 which is internally threaded at 14 and is screwed onto the external threading 20 of a stainless steel end piece 16 which has an external flange 18. The threaded screw connections 14 and 20 have a sealant 22 applied thereon. A fastening ring 24 is mounted on the external flange 18 of the end piece 16, being adapted to secure the connector assembly 10 onto the solenoid valve of an air gun (not shown) by screws passing through the holes 25.

Figure 2:
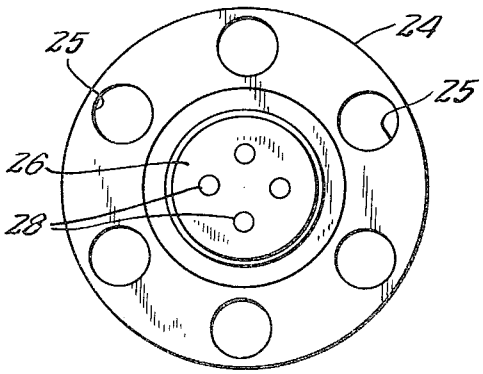
FIG. 2 is an elevational view of the socket end of the connector of FIG. 1 as seen from the position 2—2 in FIG. 1.

The end piece 16 includes a contact retainer 26 of suitable insulating material, such as glass-filled Delrin, in which are mounted a plurality of electrical contacts in the form of sockets 28, for example four are included, as seen in FIG. 2. Electrical connections are thus provided for the solenoid valve of the air gun by a suitable male plug having contact prongs received into the contact sockets 28 of the connector assembly 10.

Figure 4:
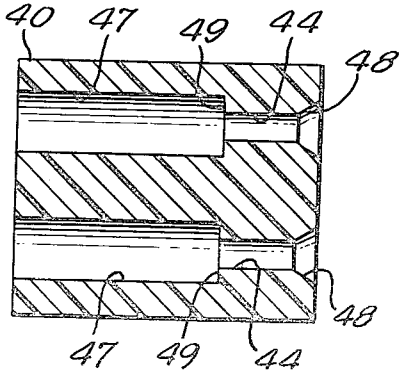
FIG. 4 is an axial sectional view of the non-conductive anchor plug of FIG. 3, taken along the plane 4—4 in FIG. 3.
Figure 3:
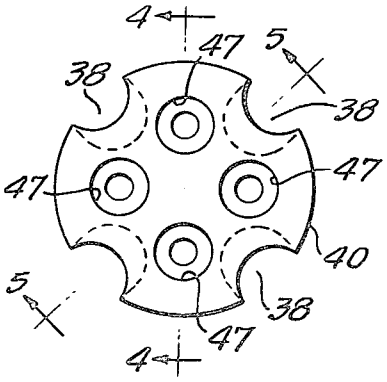
FIG. 3 is an end elevational view shown on enlarged scale particularly illustrating the non-conductive anchor plug of FIG. 1.

In order to enable the electrical cable 30 and the connector assembly 10 to withstand the large vibrational stresses generated by the repeated firings of the air gun as well as other tension and flexural stresses resulting from the towing of a relatively long length of the cable 30 through a body of water, this electrical cable has a plurality of insulated, high tensile strength stranded electrical conductors 32, for example four of them. Each strand in the stranded conductors 32 is a steel core wire with copper cladding for providing both mechanical strength and electrical conductivity. For example, each of the electrical conductors 32 may be 14 gauge (American Wire Gauge) 40 percent conductivity "Copperweld" wire. There is a layer 33 of electrical insulation sheathing each of the stranded conductors 32 with a tough protective insulating sheath 35 around the exterior of this cable 30. The bared ends of the plurality of electrical conductors 32 of the cable 30 are mechanically fastened by crimping in respective electrical connector sleeve elements 46 positioned in sockets 47 (FIGS. 3 and 4) in a non-conductive anchor plug 40 which acts as a strain-relief member. The anchor plug 40 is preferably a glass fiber plastic matrix, or any other suitable strong non-conductive material, such as a tough phenolic laminate, which abuts axially against an internal shoulder 42 of the sleeve body member 12. The insulated electrical conductors 32 extend through passages 44 (See also FIGS. 3 and 4) in the anchor plug 40. The outer ends of these passages 44 are flared out as seen at 48 in FIG. 4, and there are internal shoulders 49 in the anchor plug 40 against which the electrical connector elements 46 (FIG. 1) are seated. As will be seen in FIG. 3, the anchor plug 40 is fluted at 38 around the outside diameter thereof to provide a plurality of longitudinally extending channels which facilitate the encapsulation of the whole interior of the connector assembly 10 as will be explained further below.

For convenience of reference the left and right ends of the connector assembly 10 and of the respective components therein as seen in FIG. 1 will be referred to as the socket end and cable end, respectively. It is noted that the channel flutes 38 are made deeper by tapering them at 51 toward the cable end of the anchor plug 40.

In order to connect the electrical conductors 32 of the cable 30 to the sockets 28 in the socket retainer 26, a plurality of smaller gauge hook-up wires 50 are coupled at one end thereof to the electrical connector elements 46. These electrical conductors 50 are crimped in the connector elements 46. The other ends of these electrical conductors 50 are soldered into the cable ends of the respective sockets 28 and are supported by insulating shrink tubing 52 which is mounted on the contact sockets 28 in the retainer socket 26.

After the cable 30 is attached to the connector assembly 10, the internal cavity 55 in the sleeve body member 12 is filled with a suitable insulating potting material, such as polyurethane, through a threaded port 56 in the stainless steel body member 12. The fluting 38 in the non-conductive anchor plug 40 permits the flow of the potting compound to the other end of this plug, thereby filling the region where the insulated conductors 32 enter the flared out ends 48 of the passages 44 in the sleeve body member 12. Accordingly, the entire internal space 55 of the stainless steel body member 12 and the components therein are totally encapsulated with this potting material. After filling with potting compound is complete, a screw plug 58 is inserted in the port 56 and is screwed below the outer surface of the sleeve body member 12, and a sealant 60 is applied over the outer end of this plug 58.

The electrical cable 30 is sheathed in a suitable insulation layer 35, such as rubber, so that the insulated conductors 32 are completely surrounded by a protective layer of insulation. Although only two wires 32 are required for energizing the winding of the solenoid valve, four insulated conductors 32 may be provided within the cable 30, the other two being used to monitor the firing of the air gun in a manner which does not form a part of the present invention. If such monitoring is not used, the four wires may be paired together for providing a dual circuit for operating the solenoid valve to provide redundancy for increased reliability for if one wire in either part should break the other would still operate to control the solenoid valve or other electrically controlled apparatus to which the connector assembly 10 is fastened.

A flexural and torsional transition member in the form of a tapered stiffly flexible insulator jacket 62 is molded around and bonded to the cable 30 and over a reduced diameter extending end portion 34 of the sleeve body 12. The tapered transition jacket 62 may be of any suitable tough, stiff and flexible insulating material such as rubber. A lip 64 in the stainless steel sleeve body member 12 mates with the connector end of the jacket 62 to enhance the bonding strength of the connection thereto. The extending end portion 34 of the connector body 12 is externally threaded as seen in FIG. 1 for enhancing the strength of the bonding to the connector end of the jacket 62. This jacket 62 has a slightly larger diameter than the connector body 12 and its connector end is finished off by a steep inward taper at 65 just beyond the lip 64. The tapered jacket 62 is also finished off by being tapered inwardly more steeply at 66 toward the cable end thereof.

The electrical cable and connector assembly are assembled by sliding the sleeve body member 12 over the cable 30. The ends of the conductors 32 of the cable are stripped of their insulation 33 and slid in through the passages 44 of the non-conductive anchor plug 40 and are crimped in the electrical connector elements 46. The hookup conductors 50 are also crimped in the electrical connectors 46 and their other ends are soldered into the sockets 28 which have shrink tubing 52 applied thereto. Sealant 22 is then applied to threads 14 and 20 and the stainless steel sleeve body 12 having its fastener ring 24 around it is screwed on to the end piece 16 with only the sleeve body being turned. The cavity 55 is then filled with potting material, such as polyurethane, using the filler port 56 in the wall of the sleeve body 12. As pointed out above, the fluted exterior of the anchor plug 40 permits filling of the entire interior of the sleeve body 12 with the potting material, thereby encapsulating all of the components therein. The screw plug 58 is then screwed into the port 56 until it has been sunk completely below the outside of the sleeve body 12, and the end of this plug is sealed over with sealant 60. The screw plug 58 subjects the potting material to some compression within the cavity 55 thereby firmly holding the encapsulated components against vibration.

Figure 5:
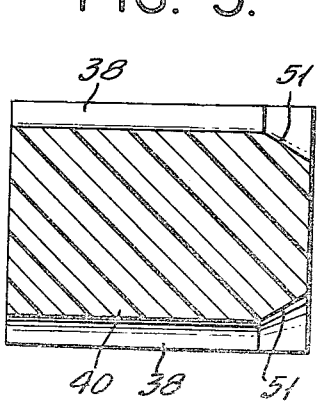
FIG. 5 is another axial sectional view of the non-conductive anchor plug of FIG. 3, taken along the plane 5—5 in FIG. 3.

It is to be understood that the potting material also fills the interior at 55' of the extension 34 in the cable end of the sleeve body member 12. The deepening slope 51 (FIG. 5) on the cable end of the channels 38 in the perimeter of the anchor plug 40 permit the potting material to flow past the anchor plug and into the cable end region 55'. The potting material is omitted in the drawing from the region 55' for clarity of illustration.

It will be observed that the insulated conductors 32 within the cable 30 are more centrally located and are located relatively nearer the axis of the cable than was the case with respect to the cable structure described in U.S. Pat. No. 3,588,039. This arrangement of the high tensile strength stranded conductors 32 in effect spaces them further from the periphery of the cable thereby tending to equalize the stresses in the individual conductors caused by torsion, flexing, tension and vibration. Moreover, the cable 30 is of considerably smaller overall diameter, thereby advantageously reducing the flexure stresses when it sags and bends during towing, and in addition the smaller diameter of the cable reduces the drag forces caused by its being pulled through the water at a given speed as compared with a larger diameter cable of the same length. Furthermore, a rather large steel cable core has advantageously been eliminated. The electrical conductors of the cable are secured in a non-conductive anchor plug which insulates them from each other as well as receiving and anchoring the pulling forces on the cable and reduces the opportunity for short circuit to occur as compared with the prior art arrangement in which the conductors extended through a steel plug. The internal connections within the connector assembly are conveniently provided by small gauge electrical conductors which are isolated by the non-conductive anchor plug from the mechanical stresses put on the cable. Accordingly, the invention provides a rugged and reliable high strength submersible electrical cable and connector assembly which may be utilized in marine seismic surveying operations and other similar applications.

Since other modifications and changes varied to fit particular operating requirements and environments will be apparent to those skilled in the art, the invention is not considered limited to the examples chosen for purposes of illustration, and includes all changes and modifications which do not constitute a departure from the true spirit and scope of this invention.

What is claimed is:

1. A high strength submersible marine seismic surveying electrical cable and connector assembly adapted to be coupled to solenoid-valve operated high pressure air guns and adapted to be towed through the water behind a ship while connected to an air gun for marine seismic surveying comprising:

a submersible electrical cable having a plurality of insulated high tensile strength electrical conductors extending longitudinally therein generally near the axis thereof and each being individually sheathed in insulation with a layer of insulation surrounding all of the individually insulated conductors;

a submersible connector having a metal sleeve member with a contact retainer formed of dielectric material mounted in one end of said sleeve member holding a plurality of electrical contacts, said connector being adapted to be connected to a solenoid valve on high pressure air gun apparatus for marine seismic surveying;

said metal sleeve member having an internal annular shoulder facing toward said one end in which said contact retainer is mounted;

a non-conductive rigid anchor plug of tough, strong insulation material mounted within said sleeve body and having a plurality of electrical connector elements seated therein;

said non-conductive anchor plug being seated against said internal annular shoulder for resisting movement in a direction away from said one end of said sleeve member;

said non-conductive anchor plug having internal shoulders facing toward said one end of said sleeve member and said connector elements being seated against the respective internal shoulders in said anchor plug for resisting movement in a direction away from said one end of said sleeve member;

the ends of the conductors of said cable extending into said sleeve member through its cable end and being bared and being secured in the respective connector elements in said anchor plug for mechanically and electrically securing said plurality of high tensile strength electrical conductors in said anchor plug for resisting tension stress on said cable in a direction away from said sleeve member and for electrically insulating said conductors from each other and from said metal sleeve;

a plurality of small gauge electrical conductors individually coupled between the respective electrical connector elements and the respective electrical contacts in said retainer;

said sleeve member having a port therein for filling the interior of said sleeve member with potting insulating material;

means for plugging said port watertight after the interior of the sleeve member has been filled with potting material; and an insulating tapered stiffly flexible jacket surrounding said electrical cable and surrounding the cable end of said sleeve member where said electrical cable enters said sleeve member for providing flexural and torsional stress transition between said cable and said sleeve member of said connector assembly;

whereby said submersible electrical cable and connector assembly can be connected to a solenoid-valve operated air gun and can be towed through the water for carrying out marine seismic surveying operations.

2. The high strength submersible electrical cable and connector assembly set forth in claim 1 in which said non-conductive anchor plug is formed of a glass fiber and tough plastic matrix.

3. The high strength submersible electrical cable and connector assembly set forth in claim 1 or 2 in which said plurality of electrical connector elements in said anchor plug comprise electrical connector sleeves permanently crimped onto the bared ends of said high tensile strength electrical connectors, said connector elements being individually seated in respective sockets in said non-conductive anchor plug and also being permanently crimped onto said small gauge conductors for electrically connecting them individually to the high strength electrical conductors, and said internal shoulders in said anchor plug individually encircling said sockets and engaging against the ends of the respective connector sleeves for resisting tension stress.

4. The high strength submersible electrical cable and connector assembly set forth in claim 1 or 2 in which said anchor plug is fluted in configuration forming a plurality of spaced parallel straight channels extending longitudinally along portions of its perimeter in a direction parallel with the axis of said sleeve member, for permitting said potting material to flow through the channels for completely encapsulating said anchor plug within said sleeve member, said channels in the perimeter of said non-conductive anchor plug being deepened adjacent to said internal annular shoulder in said sleeve member for permitting the potting material to flow around said anchor plug and into the interior of the sleeve member near the cable end thereof.

5. A high strength submersible electrical cable and connector assembly adapted to be coupled to solenoid-valve operated high pressure air guns for towing through the water behind a ship while connected to an air gun for performing marine seismic surveying comprising:

a submersible electrical cable having a plurality of insulated high tensile strength electrical conductors extending longitudinally therein generally near the axis thereof and each being individually sheathed in insulation with an outer waterproof covering of insulation surrounding all of the individually insulated conductors;

a submersible connector having a generally cylindrical metal sleeve body with a contact retainer of dielectric material mounted in one end holding a plurality of electrical contacts, said connector being adapted to be connected to a solenoid valve on high pressure air gun apparatus for marine seismic surveying;

said metal sleeve body having an internal annular shoulder therein facing toward said one end;

a non-conductive rigid anchor plug of tough, strong insulation material mounted within said sleeve body and seated against said internal annular shoulder for resisting movement relative to said sleeve body in a direction away from said one end;

said anchor plug having a plurality of electrical connector elements seated therein;

said anchor plug having internal shoulders facing toward said one end of the sleeve body and said connector elements being seated against the respective internal shoulders in said anchor plug for resisting movement relative to said anchor plug in a direction away from said one end of the sleeve body;

said cable extending into the opposite axial end of said sleeve body from said one end and the end portions of the conductors of said cable being bared and being secured in the respective connector elements in said anchor plug for mechanically and electrically securing said plurality of high tensile strength electrical conductors in said anchor plug and for resisting pulling stress on said cable in a direction away from said sleeve body;

a plurality of flexible electrical conductors being individually secured in the respective connector elements and also being individually secured to the electrical contacts in said retainer for electrically connecting said cable conductors individually to said contacts;

the interior of said sleeve body surrounding said flexible electrical conductors near said one axial end of said non-conductive anchor plug and surrounding said end portions of said cable conductors near said opposite axial end;

said non-conductive anchor plug having a plurality of axially extending channels therein for providing communication between its opposite axial ends, said channels providing clearance past said internal annular shoulder in said sleeve body for permitting potting material to flow past said anchor plug;

said sleeve body having a port therein for filling the interior of said sleeve body with insulating potting material, and said channels enabling said potting material to fill the interior of said sleeve body near both ends of said non-conductive anchor plug;

means for plugging said port watertight after the interior of the sleeve body member has been filled with potting material; and an insulating tapered stiffly flexible jacket surrounding said electrical cable and said opposite end of said sleeve body where said electrical cable enters said sleeve body for providing flexural and torsional stress transition between said cable and said sleeve body of said connector assembly, whereby said submersible electrical cable and connector assembly can be connected to a solenoid-valve operated air gun and can be towed through the water for carrying out marine seismic surveying operations.

* * * * *